US011731058B2

(12) United States Patent
Blum et al.

(10) Patent No.: US 11,731,058 B2
(45) Date of Patent: Aug. 22, 2023

(54) MOTION GENERATING PLATFORM ASSEMBLY

(71) Applicant: Universal City Studios LLC, Universal City, CA (US)

(72) Inventors: Steven C. Blum, Orlando, FL (US); Steven King, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 136 days.

(21) Appl. No.: 17/342,263

(22) Filed: Jun. 8, 2021

(65) Prior Publication Data

US 2021/0291065 A1 Sep. 23, 2021

Related U.S. Application Data

(63) Continuation of application No. 16/551,549, filed on Aug. 26, 2019, now Pat. No. 11,027,210, which is a (Continued)

(51) Int. Cl.

*A63G 31/14* (2006.01)
*A63G 1/00* (2006.01)

(Continued)

(52) U.S. Cl.

CPC ..... *A63G 31/14* (2013.01); *A63G 1/00* (2013.01); *A63G 1/08* (2013.01); *A63G 7/00* (2013.01);

(Continued)

(58) Field of Classification Search

CPC . A63G 31/14; A63G 1/00; A63G 1/08; A63G 7/00; A63G 21/20; A63G 31/02;

(Continued)

(56) References Cited

U.S. PATENT DOCUMENTS 328,899 A 10/1885 Morrison
3,333,713 A 8/1967 Cruciani (Continued)

FOREIGN PATENT DOCUMENTS

CN 102309853 1/2012
CN 202751825 2/2013

(Continued)

OTHER PUBLICATIONS

EP 18706161.9 Office Action dated Nov. 22, 2021.

(Continued)

*Primary Examiner* — Michael D Dennis
(74) *Attorney, Agent, or Firm* — Fletcher Yoder, P.C.

(57) ABSTRACT

A ride system includes a base, a ride vehicle, a platform assembly positioned between the base and the ride vehicle, and an extension mechanism coupled to the platform assembly and positioned between the base and the ride vehicle. The platform assembly includes a first platform, a second platform, and six legs extending between the first platform and the second platform, and the platform assembly is configured to actuate each of the six legs so as to move the first platform relative to the second platform in different configurations based on which of the six legs is actuated. The extension mechanism is configured to extend and contract so as to move the ride vehicle away from and toward, respectively, the base of the ride system.

18 Claims, 8 Drawing Sheets

Related U.S. Application Data continuation of application No. 15/892,170, filed on Feb. 8, 2018, now Pat. No. 10,413,836.

(60) Provisional application No. 62/456,506, filed on Feb. 8, 2017.

(51) Int. Cl.

| | |
|---|---|
| ***A63G 21/20*** | (2006.01) |
| ***A63G 7/00*** | (2006.01) |
| ***A63G 1/08*** | (2006.01) |
| ***A63G 31/02*** | (2006.01) |
| ***A63G 31/16*** | (2006.01) |

(52) U.S. Cl.

CPC ..... *A63G 21/20* (2013.01); *A63G 31/02* (2013.01); *A63G 31/16* (2013.01)

(58) Field of Classification Search

CPC .. A63G 31/16; B61B 7/00; B61B 1/00; B61B 3/02

See application file for complete search history.

(56) References Cited

U.S. PATENT DOCUMENTS

| | | | |
|---|---|---|---|
| 3,353,503 | A | 11/1967 | Pettit |
| 3,457,876 | A | 7/1969 | Holden |
| 3,847,085 | A | 11/1974 | Rypinski |
| 4,343,610 | A | 8/1982 | Chou |
| 4,520,732 | A | 6/1985 | Schwarzkopf |
| 4,543,886 | A | 10/1985 | Spieldiener et al. |
| 4,558,790 | A | 12/1985 | Bruce-Walker |
| 4,641,587 | A | 2/1987 | Dalliard |
| 4,666,362 | A | 5/1987 | Landsberger et al. |
| 4,883,184 | A | 11/1989 | Albus |
| 5,192,247 | A | 3/1993 | Barr et al. |
| 5,431,246 | A | 7/1995 | Matherly |
| 5,503,597 | A | 4/1996 | Lochtefeld et al. |
| 5,538,373 | A | 7/1996 | Kirkham |
| 5,568,993 | A | 10/1996 | Potzick |
| 5,752,834 | A | 5/1998 | Ling |
| 5,989,126 | A | 11/1999 | Kilbert et al. |
| 6,006,672 | A | 12/1999 | Newfarmer et al. |
| 6,095,926 | A | 8/2000 | Hettema et al. |
| 6,126,023 | A | 10/2000 | Durrant-Whyte et al. |
| 6,189,299 | B1 | 2/2001 | Brown et al. |
| 6,264,236 | B1 | 7/2001 | Aoki |
| 6,330,837 | B1 | 12/2001 | Charles et al. |
| 6,406,299 | B1 | 6/2002 | Murao et al. |
| 6,470,982 | B2 | 10/2002 | Sitarski et al. |
| 6,511,381 | B1 | 1/2003 | Cochron |
| 6,566,834 | B1 | 5/2003 | Albus et al. |
| 6,648,102 | B2 | 11/2003 | Bostelman et al. |
| 6,808,459 | B2 | 10/2004 | Checketts |
| 7,624,684 | B2 | 12/2009 | Morris |
| 7,967,688 | B2 | 6/2011 | Lai et al. |
| 8,147,344 | B2 | 4/2012 | Crawford et al. |
| 8,453,576 | B2 | 6/2013 | Roodenburg et al. |
| 8,505,392 | B2 | 8/2013 | Zhang et al. |
| 8,641,540 | B2 | 2/2014 | Feuer et al. |
| 8,684,854 | B2 | 4/2014 | Fisher |
| 8,721,464 | B2 | 5/2014 | Ou Yang et al. |
| 8,768,492 | B2 | 7/2014 | Fisher |
| 8,909,379 | B2 | 12/2014 | Fisher |
| 8,947,295 | B2 | 2/2015 | Collins |
| 8,961,326 | B2 | 2/2015 | Fisher |
| 9,026,235 | B2 | 5/2015 | Fisher |
| 9,096,294 | B1 | 8/2015 | Dong et al. |
| 9,109,741 | B2 | 8/2015 | Kempf et al. |
| 9,302,190 | B1 | 4/2016 | Jennings |
| 9,303,421 | B1 | 4/2016 | Jennings |
| 9,393,497 | B2 | 7/2016 | Valtiner-Zuegg et al. |
| 9,732,535 | B2 | 8/2017 | Jennings |
| 9,842,509 | B2 | 12/2017 | Van Lookeren Campagne et al. |
| 2002/0029610 | A1* | 3/2002 | Chrystall ..... A43D 999/00 73/7 |
| 2005/0014566 | A1* | 1/2005 | Hashimoto ..... A63G 31/16 472/59 |
| 2006/0070817 | A1* | 4/2006 | Campbell ..... E04G 1/22 187/238 |
| 2008/0290221 | A1 | 11/2008 | Dupuis et al. |
| 2009/0038499 | A1 | 2/2009 | Morris |
| 2009/0119030 | A1* | 5/2009 | Fang ..... A63B 24/0006 702/41 |
| 2013/0079169 | A1* | 3/2013 | Dietz ..... A63G 21/20 472/137 |
| 2014/0002297 | A1 | 1/2014 | Collins |
| 2016/0184719 | A1* | 6/2016 | D'Andrea ..... F16M 11/048 700/275 |
| 2017/0072327 | A1 | 3/2017 | Wach |
| 2017/0148338 | A1 | 5/2017 | So et al. |
| 2020/0320897 | A1* | 10/2020 | Veltena ..... A63G 31/16 |

FOREIGN PATENT DOCUMENTS

| | | | |
|---|---|---|---|
| CN | 203750188 | | 8/2014 |
| CN | 204655988 | | 9/2015 |
| CN | 204833773 | | 12/2015 |
| EP | 1063064 | | 12/2000 |
| EP | 2394720 | | 12/2011 |
| GB | 2305645 | | 4/1997 |
| JP | 2006259363 | | 9/2006 |
| KR | 20140126947 | A | 11/2014 |
| WO | 8301428 | | 4/1983 |
| WO | 9956846 | A1 | 11/1999 |
| WO | 2013051960 | | 4/2013 |
| WO | 2015080759 | A1 | 6/2015 |

OTHER PUBLICATIONS

PCT/US2018/017459 Invitation to Pay Additional Fees dated May 3, 2018.

Chao, Min et al.; "Dynamic analysis of a 6-DOF inverted stewart platform," 2010; NERAC Research Report #11540774, Aug. 8, 2016, Key Engineering Materials, vol. 419-420, pp. 13-16.

Liu, Qing et al.; "Adaptive Control for a Crane-Mounted Inverted Stewart Platform," Feb. 27, 2000; NERAC Research Report #11540774, Aug. 8, 2016.

Buterbaugh, A. et al.; "Demonstration of an Inverted Stewart Platform Target-Suspension System Using Lightweight, High-Tensile Strings," 2007; NERAC Research Report #11540774, Aug. 8, 2016, IEEE Antennas & Propagation Magazine, vol. 49.

CA3,052,645 Office Action dated Oct. 30, 2020.

* cited by examiner

MOTION GENERATING PLATFORM ASSEMBLY

CROSS REFERENCE TO RELATED APPLICATIONS

This application is a continuation of U.S. patent application Ser. No. 16/551,549, entitled "Motion Generating Platform Assembly," filed Aug. 26, 2019, which claims priority to and benefit of U.S. patent application Ser. No. 15/892,170, entitled "Motion Generating Platform Assembly," filed Feb. 8, 2018, which claims priority to and the benefit of U.S. Provisional Patent Application Ser. No. 62/456,506, entitled "Inverted Stewart Platform and Flying Reaction Deck," filed Feb. 8, 2017, all which are herein incorporated by reference in their entireties for all purposes.

BACKGROUND

The present disclosure relates generally to the field of amusement parks. More specifically, embodiments of the present disclosure relate to ride systems and methods having features that enhance a guest's experience.

Various amusement rides and exhibits have been created to provide guests with unique interactive, motion, and visual experiences. For example, a traditional ride may include a vehicle traveling along a track. The track may include portions that induce a motion on the vehicle (e.g., turns, drops), or actuate the vehicle. However, traditional ride vehicle actuation (e.g., via curved track) may be costly and may include a large ride footprint. Further, traditional ride vehicle actuation (e.g., via curved track) may be limited with respect to certain desired motions and, thus, may not create the desired sensation for the passenger. Accordingly, improved ride vehicle actuation is desired.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In one embodiment, a ride system includes a base, a ride vehicle, a platform assembly positioned between the base and the ride vehicle, and an extension mechanism coupled to the platform assembly and positioned between the base and the ride vehicle. The platform assembly includes a first platform, a second platform, and six legs extending between the first platform and the second platform, and the platform assembly is configured to actuate each of the six legs so as to move the first platform relative to the second platform in different configurations based on which of the six legs is actuated. The extension mechanism is configured to extend and contract so as to move the ride vehicle away from and toward, respectively, the base of the ride system.

In another embodiment, a ride system includes a platform assembly, where the platform assembly includes a first platform, a second platform, and six legs extending between the first platform and the second platform. The first platform includes a first anchor position to which a first leg and a second leg of the six legs are coupled, a second anchor position to which a third leg and a fourth leg of the six legs are coupled, and a third anchor position to which a fourth leg and a fifth leg of the six legs are coupled. The second platform includes a fourth anchor position to which the third leg and the sixth leg are coupled, a fifth anchor position to which the second leg and the fifth leg are coupled, and a sixth anchor position to which the first leg and the fourth leg are coupled. The first anchor position is aligned with the fourth anchor position when the six legs are of equal lengths, the second anchor position is aligned with the fifth anchor position when the six legs are at equal lengths, and the third anchor position is aligned with the sixth anchor position when the six legs are at equal lengths.

In another embodiment, a method of operating a ride vehicle includes supporting, via a plurality of cables, a ride vehicle under a track of the ride system. The method also includes monitoring, via a controller, forces in the ride system. The method also includes modulating, via instruction by the controller of a plurality of motors corresponding to the plurality of cables, a torque output of the plurality of motors based on the monitored forces in the ride system.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
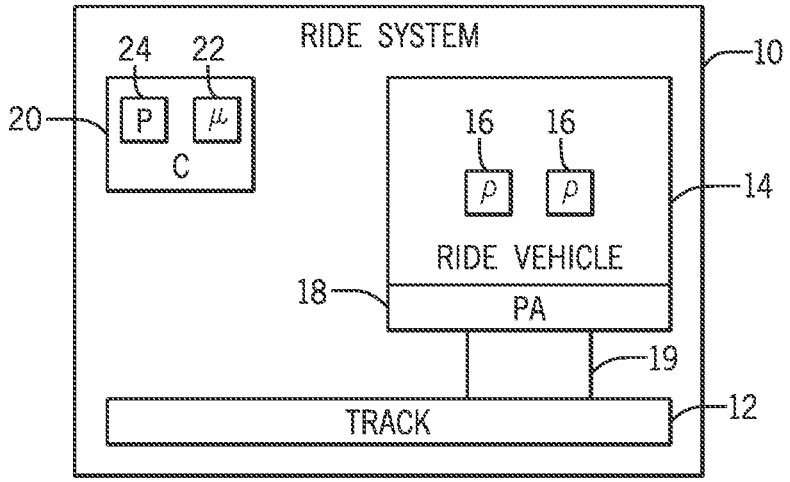
FIG. 1 is a schematic illustration of an embodiment of a ride system having a platform assembly, an extension mechanism, and feedback control features, in accordance with an embodiment of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed toward amusement park rides and exhibits. Specifically, the rides and exhibits incorporate a motion-based system and corresponding techniques that may be designed or intended to cause a passenger to perceive certain sensations that would not otherwise be possible or would be significantly diminished by a traditional ride system. In the presently disclosed rides and exhibits, the passenger experience may be enhanced by employing certain motion-based systems and techniques. For example, the ride system may incorporate a device that produces, or devices that produce, up to six degrees of freedom to provide sensations to the passengers that cannot normally be created from traditional methods (e.g., turns, drops). The device may include two platforms that are coupled via legs extending therebetween. The legs are coupled to particular locations along the two platforms, and at angles with respect to the two platforms, so as to cause the two platforms to move relative to one another when the legs (or corresponding features) are actuated. One manner by which the platforms may be coupled via the legs, in accordance with the present disclosure, is referred to herein as an "inverted Stewart platform," which differs from a traditional Stewart platform. A traditional Steward platform may be described as having opposing platforms which are connected by legs, where the legs extend in pairs from three extension regions on each of the two opposing platforms. The inverted Stewart platform includes six legs extending between opposing platforms, where the six legs extend from positions along the opposing platforms, and are oriented between the opposing platforms, in ways that differ substantially from those of the traditional Stewart platform. The different positions/orientations of the inverted Stewart platform, which will be described in detail below and with reference to the drawings, are configured to enhance, among other things, stability of the inverted Stewart platform and corresponding ride components.

In general, a first of the two platforms of the inverted Stewart platform noted above may be coupled with (or correspond to) a vehicle of the amusement park ride or exhibit, whereas a second of the two platforms may be coupled with (or correspond to) a track of the amusement park ride (or a base of the exhibit). In some embodiments, an extension mechanism may be disposed between the first platform and the ride vehicle, or between the second platform and the track or base. The legs coupling the first and second platforms may be controlled (e.g., retracted, extended, or otherwise actuated) to move the first platform relative to the second platform, thereby causing the ride vehicle coupled to (or corresponding to) the first platform to move along with the first platform. In embodiments having the above-described extension mechanism, the extension mechanism may be actuated independently, or in conjunction with the above-described legs of the inverted Stewart platform, to augment, supplement, or interact with the movement and corresponding sensations imparted by the inverted Stewart platform.

Presently described embodiments permit a wide range of motion without requiring the use of a curved track. Thus, a footprint of the ride system in accordance with present embodiments may be reduced. Further, presently disclosed embodiments may increase a range of motion of the ride vehicle, may enable more finely tuned actuation than traditional ride systems. For example, a wider range of motion may be provided via the inverted Stewart platform, and the inverted Stewart platform may facilitate improved ride stability. Further still, actuation may be imparted to the ride vehicle without occupants of the ride vehicle visualizing a source of the actuation. As such, presently disclosed embodiments may enhance the ride experience by immersing the passenger in a 3-dimensional environment without an obvious track or base. In certain embodiments, an environment of the ride system may include features separate from the vehicle and/or track, where the environmental features may be positioned, oriented, or otherwise situated so as to appear as though the environmental features themselves impart the actuation to the ride vehicle that, as described above, actually originates from the inverted Stewart platform and/or the extension mechanism. In other words, presently disclosed embodiments may facilitate actuation via components that are not perceivable by the occupant of the ride vehicle. Furthermore, present embodiments may permit ride designers to deliver simulated experiences involving displacement, velocity, acceleration, and jerk while at any portion of the ride track, which may save costs and engineering complexity. Still further, disclosed embodiments are configured to detect and manage reactionary forces associated with movement of the ride vehicle. These and other features will be described in detail below, with reference to the drawings.

Further to the points above, the arrangement of motion controlled axes in accordance with the present disclosure provides geometric stability due to more acute actuation angles than conventional approaches for a given gross motion base volumetric envelope. In one preferred embodiment, this amounts to greater force components in directions stabilizing lateral movement between motion base mounting planes. Further, the reduced actuation angles may facilitate smaller platform sizes, as described in detail with reference to the drawings below.

FIG. 1 is a schematic illustration of an embodiment of a ride system 10 having a track 12. The track 12 may be a circuit such that a ride vehicle 14 of the ride system 10 starts at one portion of the track 12 and eventually returns to the same portion of the track 12. The track 12 may include turns, ascents, or descents, or the track (or portions thereof) may extend in a single direction. In certain embodiments, the ride vehicle 14 may travel below (i.e., under) the track 12, for a duration of the ride, or for portions thereof. The ride vehicle 14 may include multiple passengers 16 who are disposed within the ride vehicle 14. In certain embodiments, the ride vehicle 14 may include an enclosure (e.g., a cabin) to enclose the passengers 16. The passengers 16 may be loaded on, or unloaded from, the ride vehicle 14 at a portion (e.g., a dock) of the track 12. In other embodiments, the track 12 may not be included or utilized as part of the ride.

In addition, the ride vehicle 14 may also include a platform assembly 18 that induces motion on the ride vehicle 14. In certain embodiments, the platform assembly 18 may be directly coupled to the track 12 and/or directly coupled to the ride vehicle 14. In other embodiments, the platform assembly 18 may be indirectly coupled to the track 12 and/or indirectly coupled to the ride vehicle 14, meaning that intervening components may separate the platform assembly 18 from the track 12 and/or ride vehicle 14. The platform assembly 18 may induce motion (e.g., roll, pitch, yaw) onto the ride vehicle 14 to enhance an experience of the passengers 16. In some embodiments, an extension mechanism 19 may be disposed between the platform assembly 18 and the track 12 (as shown), or between the platform assembly 18 and the ride vehicle 14. The platform assembly 18 and the extension mechanism 19 may be communicatively coupled to a controller 20, which may instruct the platform assembly 18 and/or the extension mechanism 19 to cause the aforementioned motions. By utilizing the platform assembly 18 and/or the extension mechanism 19 to induce certain motions on the ride vehicle 14, features (e.g., shapes) of the track 12 that are otherwise costly and increase a footprint of the ride system 10 may be reduced or negated.

The controller 20 may be disposed within the ride system 10 (e.g., in each ride vehicle 14, or somewhere on the track 12), or may be disposed outside of the ride system 10 (e.g., to operate the ride system 10 remotely). The controller 20 may include a memory 22 with stored instructions for controlling components in the ride system 10, such as the platform assembly 18. In addition, the controller 20 may include a processor 24 configured to execute such instructions. For example, the processor 24 may include one or more application specific integrated circuits (ASICs), one or more field programmable gate arrays (FPGAs), one or more general purpose processors, or any combination thereof. Additionally, the memory 22 may include volatile memory, such as random access memory (RAM), and/or non-volatile memory, such as read-only memory (ROM), optical drives, hard disc drives, or solid-state drives.

The platform assembly 18 may include an inverted Stewart platform. Examples of the inverted Stewart platform are illustrated in detail at least in FIGS. 6-9, which are described in detail below. In general, the inverted Stewart platform includes two platforms, between which legs (e.g., six legs) of the inverted Stewart platform extend. Each platform includes three contact regions (e.g., "anchor positions") at which the legs are coupled. In some embodiments, each contact region (e.g., anchor position) on one of the platforms may include a winch or winches configured to receive the legs, or an opening through which the legs extend to couple to a winch or winches on the other side of the platform.

Since each platform, for example the first platform, includes three contact regions and six legs extending therefrom, a first pair of legs extends from a first contact region of a first platform, a second pair of legs extends from a second contact region of the first platform, and a third pair of legs extends from a third contact region of the first platform. The six legs are configured to be actuated (e.g., by the aforementioned winches) such that lengths of the six legs change during operation of the inverted Stewart platform. For example, the legs may be independently actuated, actuated in pairs, or actuated in various arrangements such that different legs include different lengths during certain operating modes. In accordance with the present disclosure, when all six legs include equal lengths, the two platforms are parallel with each other (e.g., a "parallel position" of the inverted Stewart platform). Further, when all six legs include equal lengths, the three contact regions of the first platform circumferentially align with the three contact regions of the second platform. In other words, from a perspective directly above or below the inverted Stewart platform, the aforementioned three contact regions of the first platform and three contact regions of the second platform will be disposed at aligned annular positions. That is, respective contact regions on the first and second platforms line up in this configuration and they are distributed generally along the circumferences of each of the first and second platforms (or radially inward from the circumferences). Further still, when all six legs include equal lengths, the angle formed between an individual leg and one of the platforms may be 45 degrees or less, in accordance with an embodiment of the present disclosure. These features, among others, enable improved stability of the inverted Stewart platform with respect to traditional platforms.

Figure 2:
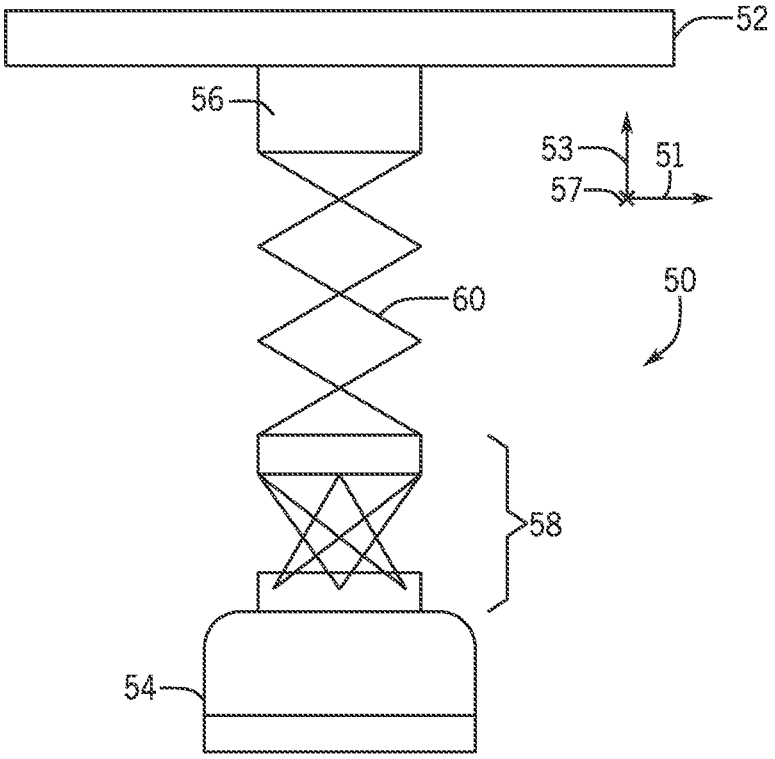
FIG. 2 is a schematic illustration of a side view of an embodiment of a ride system including a flying reaction deck having a platform assembly with an inverted Stewart platform, in accordance with an embodiment of the present disclosure.

FIG. 2 illustrates another embodiment of a ride system 50 in accordance with present embodiments. The ride system 50 includes an inverted Stewart platform 58 and an extension mechanism 60, which may be referred to collectively or individually as a "flying reaction deck" (or as a portion of the "flying reaction deck"). It should be noted that the extension mechanism 60 and/or the inverted Stewart platform 58 (or other platform assembly) may be referred to as the "flying reaction deck" because they induce motion on a ride vehicle 54 of the ride system 50 without utilizing curves of a track 52 of the ride system 50, and because the passenger(s) may be unaware of a source of the motion. Thus, the flying reaction deck is configured to impart certain sensations to passengers in the ride vehicle 54 via movement.

As an example, the extension mechanism 60 (or flying reaction deck, or part thereof) can provide additional movement complexity to a ride system that includes a simple track. As a specific example, a ride system with a straight track can be implemented to feel as though there are hills, valleys, and/or curves using the extension mechanism 60. Thus, the extension mechanism 60 moves the ride vehicle 54 without having to utilize large areas of curved track to impart the motions. By reducing curves (and, thus, area) of the track 52, components of the ride system 50 may be capable of being disposed in a smaller area, while still imparting the sensations to the passengers of the ride vehicle 54 that, in traditional embodiments, required larger areas. The inverted Stewart platform 58 may also impart motions (e.g., roll, pitch, yaw) that, in traditional embodiments, may be imparted by a track. It should also be noted that, in other embodiments, a different type of platform assembly may be used than the aforementioned inverted Stewart platform 58.

Further, the inverted Stewart platform 58 is illustrated schematically in FIG. 2, but more detailed examples are provided in FIGS. 6-9.

Continuing with the illustrated embodiment in FIG. 2, the track 52 is directly coupled to a mount 56 (e.g., bogie). In certain embodiments, the mount 56 may use wheels that may secure and roll on the track 52. The mount 56 may be coupled to the inverted Stewart platform 58 via the above-described extension mechanism 60. The extension mechanism 60 may use a scissor lift, actuators (e.g., hydraulic or pneumatic), or any combination thereof to couple the mount 56 with the inverted Stewart platform 58. The extension mechanism 60 may provide one degree of freedom (e.g., vertical disposition in the direction 53) or more on the ride vehicle 14. For example, as the ride vehicle 54 travels along the track 52, the ride vehicle 54 may come across a segment of the track 52 along which lifting of the ride vehicle 54 is desired. Thus, instead of utilizing curvature of the track 52 in the direction 53 to move the ride vehicle 54 along the direction 53, the extension mechanism 60 may activate to lift the ride vehicle 54 to a suitable vertical position. In this manner, the extension mechanism 60 may control the position of the ride vehicle 54, along the direction 53, without building hills or dips in the track 52, saving costs in manufacturing the track 52. Another embodiment of the ride system 50 is illustrated in FIG. 3, where the inverted Stewart platform 58 is coupled directly to the mount 56 and/or track 52, and the extension mechanism 60 is coupled to the ride vehicle 54 between the ride vehicle 54 and the inverted Stewart platform 58.

Figure 4:
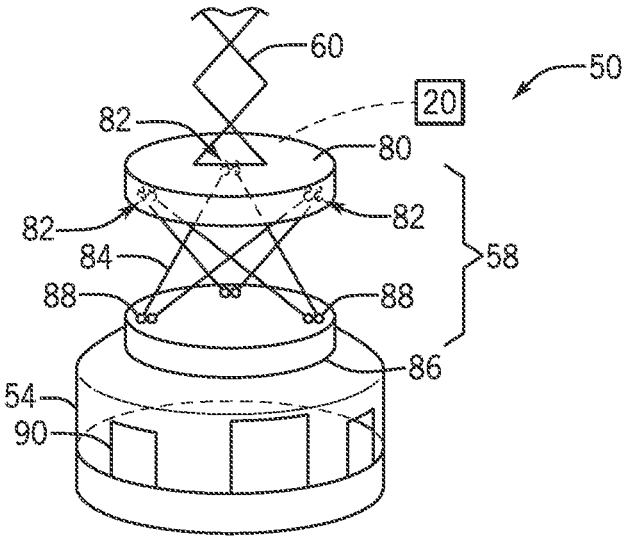
FIG. 4 is a schematic illustration of a perspective view of an embodiment of the ride system of FIG. 2 having the flying reaction deck with the inverted Stewart platform, in accordance with an embodiment of the present disclosure.
Figure 5:
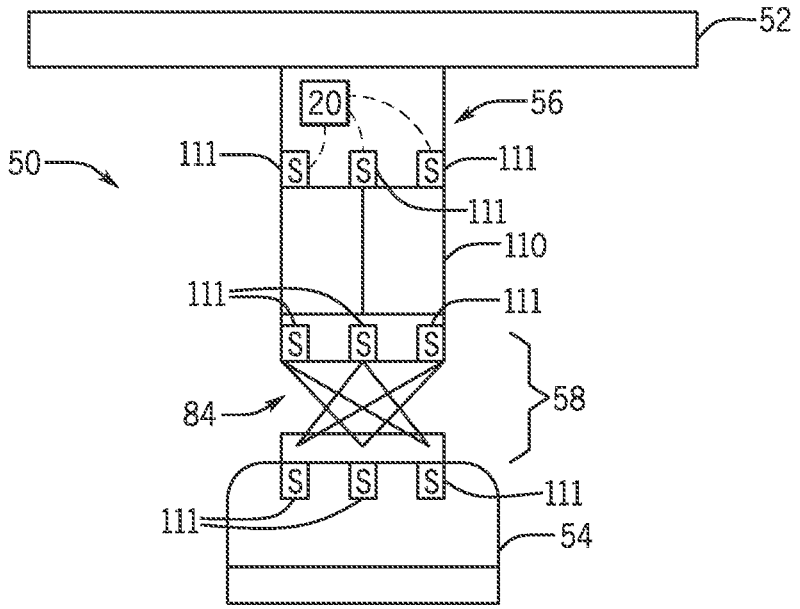
FIG. 5 is a schematic illustration of a side view of another embodiment of a ride system having the flying reaction deck with the inverted Stewart platform, in accordance with an embodiment of the present disclosure.

FIG. 4 is a schematic illustration of a perspective view of an embodiment of the ride system 50 of FIG. 2, in further detail. As shown in FIG. 4, the extension mechanism 60 is coupled to an upper platform 80 of the inverted Stewart platform 58. Winches 82 may be disposed generally along an outer perimeter of the upper platform 80 (or radially inward therefrom). The inverted Stewart platform 58 includes a set of legs 84 (e.g., six legs) which couple the upper platform 80 with a lower platform 86. In certain embodiments, the legs 84 that extend between the two platforms 80, 86 may be cables or ropes that are coupled to the winches 82 on the upper platform 80. In this manner, the winches 82 may extend and/or retract corresponding legs 84 to achieve a desired motion. The winches 82 may be communicatively coupled to the controller 20, which controls when the legs 84 extend and/or retract by instructing actuation of the winches 82. For example, in certain embodiments, the controller 20 may be programmed to activate the winches 82 to extend and/or retract the legs 84 at specific time intervals (e.g., at specific segments along the track circuit). The controller 20 may control the winches 82 independently, in pairs, or otherwise, such that the legs 84 may be controlled independently, controlled in pairs, or controlled otherwise, respectively. Furthermore, the controller 20 may monitor forces imparted on the legs 84 of the inverted Stewart platform 58 to ensure that the induced motions stay within desired thresholds. It should be noted that, in some embodiments, the winches 82 may be coupled to the lower platform 86 instead of the upper platform 80, or alternatingly between the upper and lower platforms 80, 86. In yet other embodiments, there may be pairs of winches that couple to one another via a single cord (e.g., cable or rope) to provide redundancy and additional capabilities (e.g., speed of expansion or retraction).

In the illustrated embodiment, the legs 84 are coupled to the lower platform 86 at attachment points 88 (or attachment regions) via fasteners, hooks, welds, another suitable coupling feature, or any combination thereof. The attachment points 88 securely couple the legs 84 onto the lower platform 86. The lower platform 86 is coupled to the ride vehicle 54. Thus, as the winches 82 along the top platform 50 are actuated to change lengths of the legs 84, the winches 82 pull the lower platform 86 and the attached ride vehicle 54, via the legs 84, toward the top platform 50. It should be noted that, while the description above refers to three contact regions (e.g., "anchor positions") along each platform, each platform may actually include six contact regions (e.g., anchor positions) grouped in pairs that, where the two contact regions of a given pair are disposed immediately adjacent one another.

Figure 3:
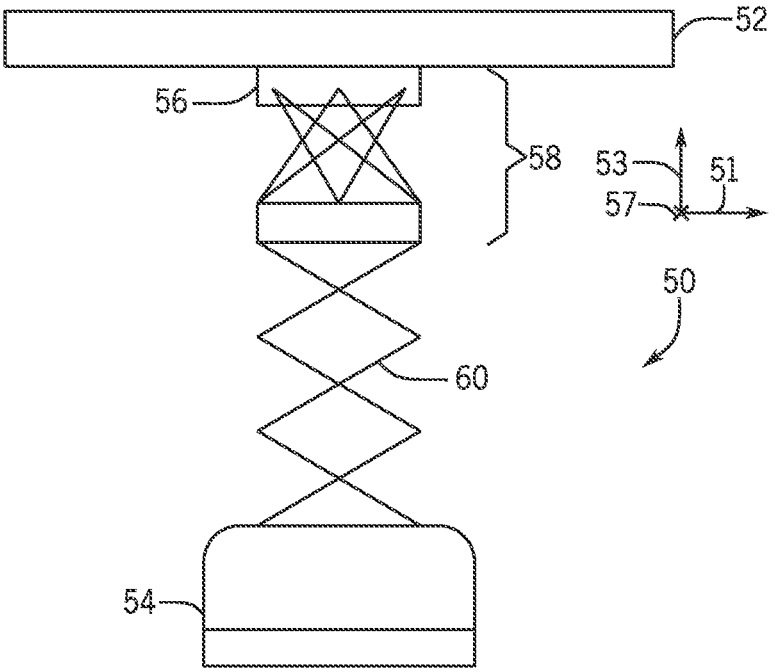
FIG. 3 is a schematic illustration of a side view of an embodiment of the ride system of FIG. 2 having the flying reaction deck with the inverted Stewart platform, in accordance with an embodiment of the present disclosure.

The embodiments of the ride system shown in FIGS. 2-4 enable the inverted Stewart platform 58 and the extension mechanism 60 to travel along with the ride vehicle 54. In addition, the inverted Stewart platform 58 and the extension mechanism 60 may be hidden from view of passengers disposed within the ride vehicle 54 (e.g., based on a limited field-of-view created by positions of windows 90 disposed on the ride vehicle 54). As such, the passengers disposed within the ride vehicle 54 may not be able to anticipate when a motion may occur. This may induce unexpected motions to enhance passenger experience. Furthermore, because the inverted Stewart platform 58 and the extension mechanism 60 travel with the ride vehicle 54, motions may be induced at any portion of the track 52 and are not limited to elements disposed on the track 52. This permits greater flexibility in generating motions and sensations and may also save costs in manufacturing the ride system 10, because additional elements (e.g., additional actuators or track segments) that generate motion may be replaced by these features. Furthermore, a size of the track 52 may be reduced, since the extension mechanism 60 and the inverted Stewart platform 58 are utilized to generate certain motions, as opposed to track curvature that would otherwise increase a track footprint. In some embodiments, the illustrated extension mechanism 60 and inverted Stewart platform 58 may be employed in an exhibit that does not include a ride (e.g., where the track 52 and mount 56 illustrated in FIG. 2 are replaced by a fixed or limited-range base). In each of FIGS. 2-4, the disclosed inverted Stewart platform, extension mechanism 60, or both are configured to manage reactionary forces associated with movement of the ride vehicle 54 during operation of the ride system 50.

In another embodiment of the ride system 50, as shown schematically in FIG. 4, instead of the extension mechanism 60 of FIGS. 2-4 (which employs a scissor lift), cables 110 may be employed. These cables 110 may be part of an actuation system (e.g., configured to extend or retract the cables 110 via a winch), or fixed. In either case, operating modes may arise where individual control of each of the cables 110, and/or of the legs of the inverted Stewart platform 58, are desired in response to reactionary forces associated with movement of the ride vehicle 54. For example, if more passengers are positioned at one end of the ride vehicle 54 than others, or if operation of the platform assembly 58 (e.g., inverted Stewart platform) shifts a weight of the ride vehicle 54 during the course of operation, movement of the ride vehicle 54 may be at least partially cycle-dependent. That is, the reaction forces caused by movement of the ride vehicle 54 may differ from one operating cycle to another, and individual control of the cables 110 and/or legs of the platform assembly 58 (e.g., inverted Stewart platform) in response to the reactionary forces may enhance a stability of the ride system 50. In such situations, control techniques may then be implemented in a way that manages cycle-dependent reactionary forces via control feedback. For example, the controller 20 may receive sensor feedback from sensors 111 dispersed about the system 50. The sensors 111 may be disposed at the mount 56, on the track 52, at the platform assembly 58, on the ride vehicle 54, or elsewhere. The sensors 111 may include torque sensors or other suitable sensors that detect torque of the ride vehicle 54. In some embodiments, the sensors 111 may include optical sensors (or other suitable sensors) that detect a position or orientation of the ride vehicle 54, which may be indicative of torque or twisting of the ride vehicle 54. For example, the position or orientation of the ride vehicle 54 may be indicative of forces in the system 50.

Figure 9:
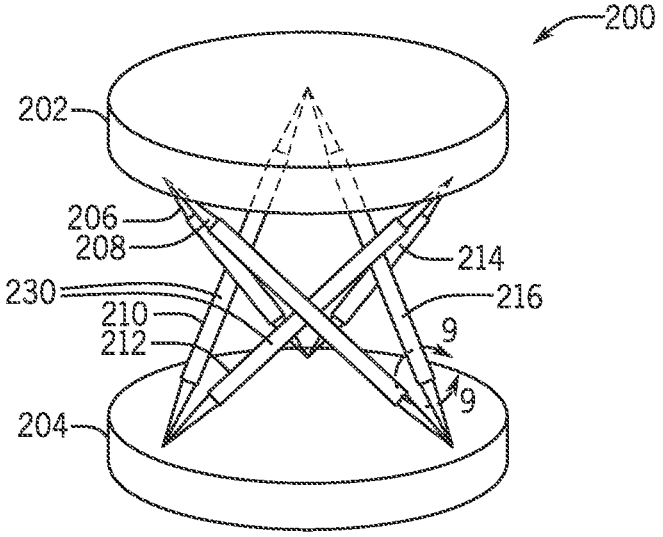
FIG. 9 is a schematic illustration of a perspective view of another embodiment of an inverted Stewart platform, in accordance with an embodiment of the present disclosure.
Figure 10:
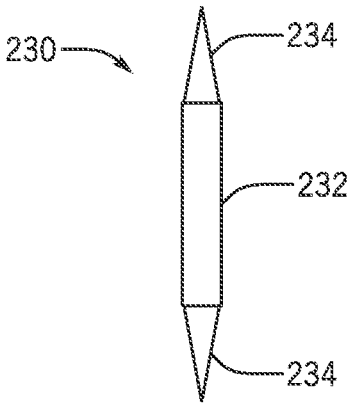
FIG. 10 is a schematic illustration of a perspective view of an embodiment of an actuator utilized in the inverted Stewart platform of FIG. 9, in accordance with an embodiment of the present disclosure.

The controller 20 may analyze the sensor feedback from one or more of the sensors 111, and may utilize a torque compensation algorithm to initiate control of tension in the cables 110, and/or to initiate extension/retraction of the legs 84 by motors (e.g., associated with the winches 82 of FIG. 4) or other actuators (e.g., as shown, and described with respect to, FIGS. 9 and 10). In some embodiments, each of the sensors 111 may be a part of a corresponding motor or other actuator that controls the cables 110 and/or legs 84 of the platform assembly 58 (e.g., inverted Stewart platform), such that the motors or other actuators control the cables 110 and/or legs 84 at the source of the detected parameters. In doing so, the cables 110 and/or legs 84 may be precluded from going slack. In other words, the torque compensation algorithm may monitor the forces in the ride system 50 to modulate the torque output of motors or other actuators controlling the movement of the legs 84 and/or the cables 110 do not go slack, which enhances stability of the ride system 50.

The embodiments illustrated in FIGS. 2-5 may also enable an improved ability to maintain stability of the ride vehicle 54 while the ride vehicle is experiencing external perturbations (e.g., via water jets), which may be employed to guide the ride vehicle 54 along a path. Indeed, as noted above, movement of the ride vehicle 54 may differ from one operating cycle to another, and in certain cases may depend on external perturbations that are associated or unassociated with the ride system 50. The implementation of torque, tension, and/or other feedback allows for stability of the ride vehicle 54 even when the position, orientation, and general motion of the ride vehicle 54 is dynamically changing during the course of the ride, or from one operating cycle to another, whether the motion is caused by features of the ride system 50 or external features that interact with the ride system 50.

Figure 6:
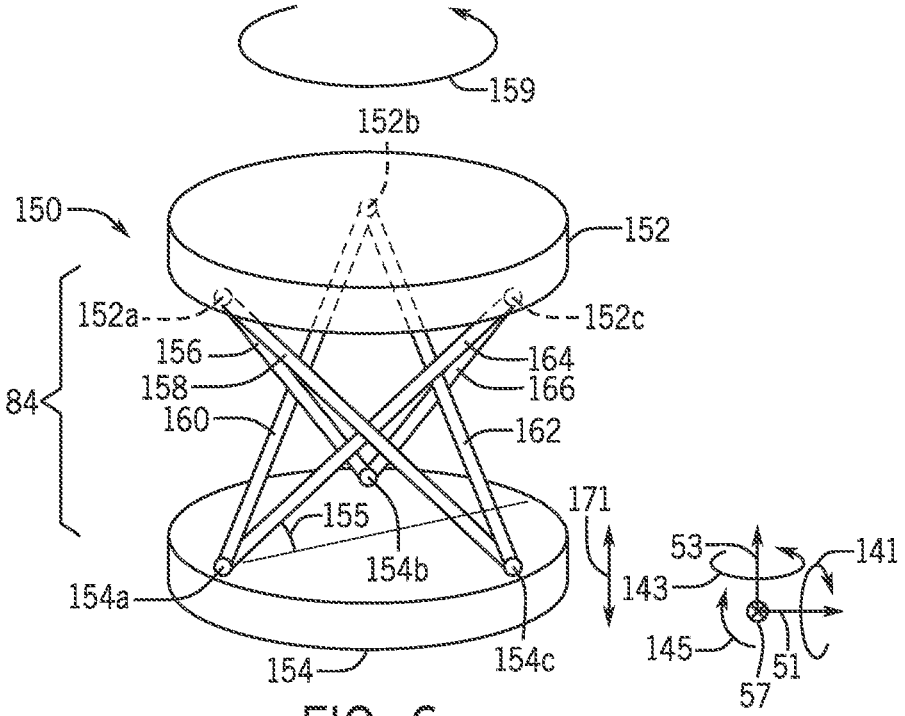
FIG. 6 is a schematic illustration of a perspective view of an embodiment of an inverted Stewart platform, in accordance with an embodiment of the present disclosure.

FIG. 6 is a schematic illustration of an embodiment of an inverted Stewart platform 150 similar to those illustrated in the preceding drawings. The inverted Stewart platform 150 includes a first platform 152 (e.g., upper platform), a second platform 154 (e.g., lower platform), and six legs 156, 158, 160, 162, 164, 166 (collectively referred to as "legs 84") extending between the upper platform 152 and the lower platform 154. The six legs 84 may be retractable and extendable, independently and/or in conjunction with each other, such that one or both of the upper and lower platforms 152, 154 may be moved in any one of six degrees of freedom (i.e., direction 51, direction 53, direction 57, roll 141, pitch 143, and yaw 145). In certain embodiments, the lower platform 154 may be coupled to, or integral with, the ride vehicle in which multiple passengers are disposed. Accordingly, as the six legs 84 are actuated (e.g., retracted/extended), the lower platform 154 and the ride vehicle may be moved in any one of the six degrees of freedom. Further, in certain embodiments, the upper platform 152 may be coupled to, or integral with, the track of the ride system such that the ride vehicle is located underneath the track. Thus, as the upper platform 152 slides along the track of the ride system, the lower platform 154 and the corresponding ride vehicle move along the same path. In other embodiments, a reverse arrangement may be employed such that the ride vehicle extends above the track, and the lower platform 154 is coupled to the ride vehicle.

In the illustrated embodiment, the upper platform 152 includes three contact regions 152*a*, 152*b*, 152*c* (e.g., "anchor positions"), and the lower platform 154 includes three other contact regions 154*a*, 154*b*, 154*c* (e.g., anchor positions) that, within the respective upper and lower platforms 152, 154, are circumferentially spaced a substantially equal distance apart from one another along a perimeter of the respective upper and lower platforms 152, 154. As previously described, winches may be disposed at the contact regions 152*a*, 152*b*, 152*c*, at the contact regions 154*a*, 154*b*, 154*c*, or both, and may be configured to extend/retract the legs 84 (e.g. via motors of, or coupled to, the winches).

As shown, each contact region 152*a*, 152*b*, 152*c*, 154*a*, 154*b*, 154*c* receives two of the six legs 84. Further, when all six legs 84 are of equal length (e.g., such that the upper and lower platforms 152, 154 are parallel to each other, as shown), the three contact regions 152*a*, 152*b*, 152*c* of the upper platform 152 are generally circumferentially aligned (e.g., aligned along a circumferential direction 159) with the three contact regions 154*a*, 154*b*, 154*c* of the lower platform 154. This may be referred to as a "parallel position" of the inverted Stewart platform 150. Thus, it may be said that, in the parallel position, assuming the platforms 152, 154 are of equal size, the contact region 152*a* is generally aligned underneath contact region 154*a*, the contact region 152*b* is generally aligned underneath contact region 154*b*, and the contact region 152*c* is generally aligned underneath contact region 154*c*. The leg 156 coupled to contact region 152*a* extends to contact region 154*b*, and the leg 158 coupled to contact region 152*a* extends to contact region 154*c*. The leg 160 coupled to contact region 152*b* extends to contact region 154*a*, and the leg 162 coupled to contact region 152*b* extends to contact region 154*c*. The leg 164 coupled to contact region 152*c* extends to contact region 154*a*, and the leg 166 coupled to contact region 152*c* extends to contact region 154*b*. Accordingly, in the illustrated embodiment, each of the legs 84 extends from an initial contact region to a contact region of the opposing platform that is not directly above or below (i.e., in the same x, y position) the initial contact region.

The configuration of the inverted Stewart platform 150 described above decreases an angle 155 between each of the legs 84 and each of the upper and lower platforms 152, 154, compared to traditional embodiments, even when the legs 84 include different lengths (e.g., during operation). The reduction in the angle 155 of the legs 84 of the inverted Stewart platform 150 (e.g., relative to traditional embodiments) may enhance stability of the inverted Stewart platform 150 by creating a larger restoring force in the legs 84. For example, the decrease in the angle 155 may increase overall stiffness of the inverted Stewart platform 150 to reduce undesired movement. Further, while traditional Stewart platform assemblies may include one large platform in order to provide stability, the reduction in the angle 155 noted above facilitates stability with smaller platforms. It should be noted that, in some embodiments, the platforms 152, 154 may not be of equal size, and that in those embodiments, the contact regions 152*a*, 152*b*, and 152*c* would still align, along the circumferential direction 159, with the contact regions 154*a*, 154*b*, and 154*c*, respectively; however, the contact regions 152*a*, 152*b*, and 152*c* of the upper platform 152, assuming a larger size of the upper platform 152, may not be disposed directly above the contact regions 154*a*, 154*b*, 154*c* of the lower platform 154, but instead may be disposed radially outward therefrom and circumferentially or annularly (e.g., along the direction 159) in alignment therewith.

As noted above, the arrangement illustrated in FIG. 6 permits a decrease in the angle 155 between any given leg 84 and the corresponding platform 152 or 154, compared with traditional Stewart platforms. In one embodiment, when all legs 156, 158 160, 162, 164, 166 are of equal length, the angles 155 formed between each leg 84 and the platform 152, 154 are 45 degrees or less. The disclosed arrangement creates a compact structure that permits stable movement in multiple degrees of freedom in accordance with present embodiments. As noted above, while traditional Stewart platform assemblies may include large platforms in order to provide stability, the reduction in the angle 155 noted above with respect to the disclosed embodiments facilitates stability with smaller platforms.

In the illustrated embodiment of the inverted Stewart platform 150, to facilitate consistent motion and distribution of forces, the legs 84 may alternate between being an "outer leg" and an "inner leg." In other words, if one starts at contact region 152*a* on the upper platform 152 and moves counter-clockwise, the leg 156 ("inner leg") of contact region 152*a* extends toward an inside of the legs 160 and 164, and the leg 158 ("outer leg") of contact region 152*a* extends toward an outside of the leg 164. Moving next to contact region 152*c*, the leg 164 ("inner leg") of contact region 152*c* extends between the legs 158 and 162, and the leg 166 ("outer leg") of contact region 152*c* extends outside of the leg 162. Moving next to contact region 152*b*, the leg 162 ("inner leg") extends between the legs 164 and 166, and the leg 160 ("outer leg") of contact region 152*b* extends outside of the leg 156. Of course, a similar arrangement, but in reverse, could be employed by swapping each of the outer and inner legs. In other embodiments, different arrangements may be utilized.

Figure 7:
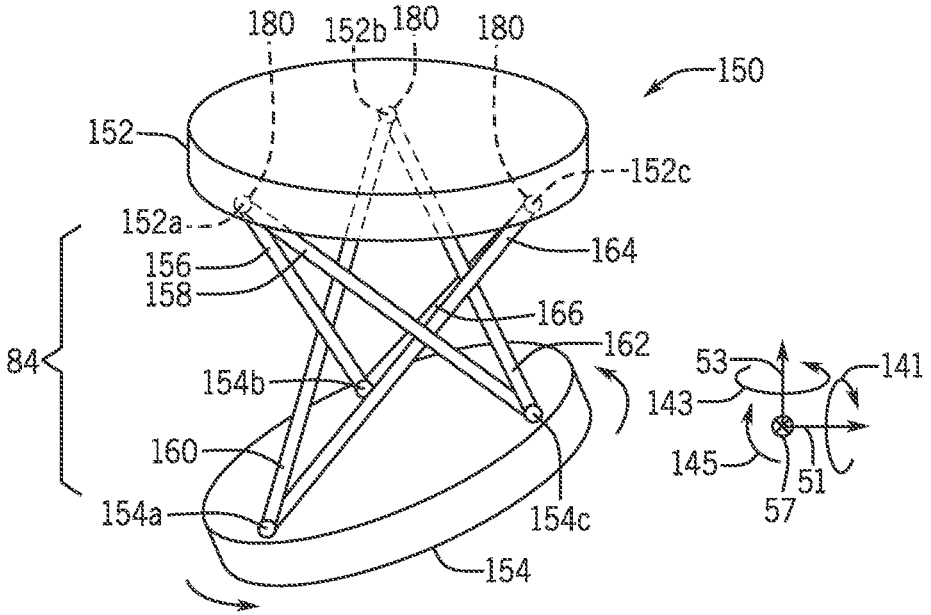
FIG. 7 is a schematic illustration of a perspective view of an embodiment of the inverted Stewart platform of FIG. 6, in accordance with an embodiment of the present disclosure.

FIG. 7 illustrates an embodiment of the inverted Stewart platform 150 of FIG. 6, with a different position/orientation of the lower platform 152. As shown in FIG. 7, the lower platform 154 has been moved such that contact region 154*a* is farther from the upper platform 154, along the direction 53, than was the case in the "parallel position" described with respect to FIG. 6. To achieve this position, the legs 160 and 164 may be extended via winches 180 (and corresponding motors thereof) to lower the contact region 154*a* in the direction 53. Likewise, the winches 180 may be utilized to retract the legs 158 and 162. If the legs 158 and 162 are retracted in length enough, the contact region 154*c* may move closer to the upper platform 152, along the direction 53, than was the case in the "parallel position" described with respect to FIG. 6. In other words, the legs 84 may be adjusted to enable the illustrated position, and to maintain stability in the inverted Stewart platform 150. In this positioning, the inverted Stewart platform 150 may induce sensations to passengers by moving the ride vehicle. For example, the ride vehicle may be coupled to the lower platform 154 and the positioning illustrated in FIG. 7 may cause the ride vehicle to go in an inclined or declined position. Similar positions can be achieved with respect to the other contact regions, since the inverted Stewart platform 150 includes a circular arrangement. Further, repositioning may instructed in a quick sequential order to enhance the sensations. Further still, repositioning may be instructed to manage or compensate for reactionary forces exerted on the system by the ride vehicle coupled to the inverted Stewart platform 150. As such, passengers on the ride vehicle may perceive that the ride vehicle is "flying" or "reacting" to various forces without the use of track curvature to impart certain of the forces, and stability of the system may be controlled in circumstances where the ride vehicle's motion diverges from a desired motion.

Figure 8:
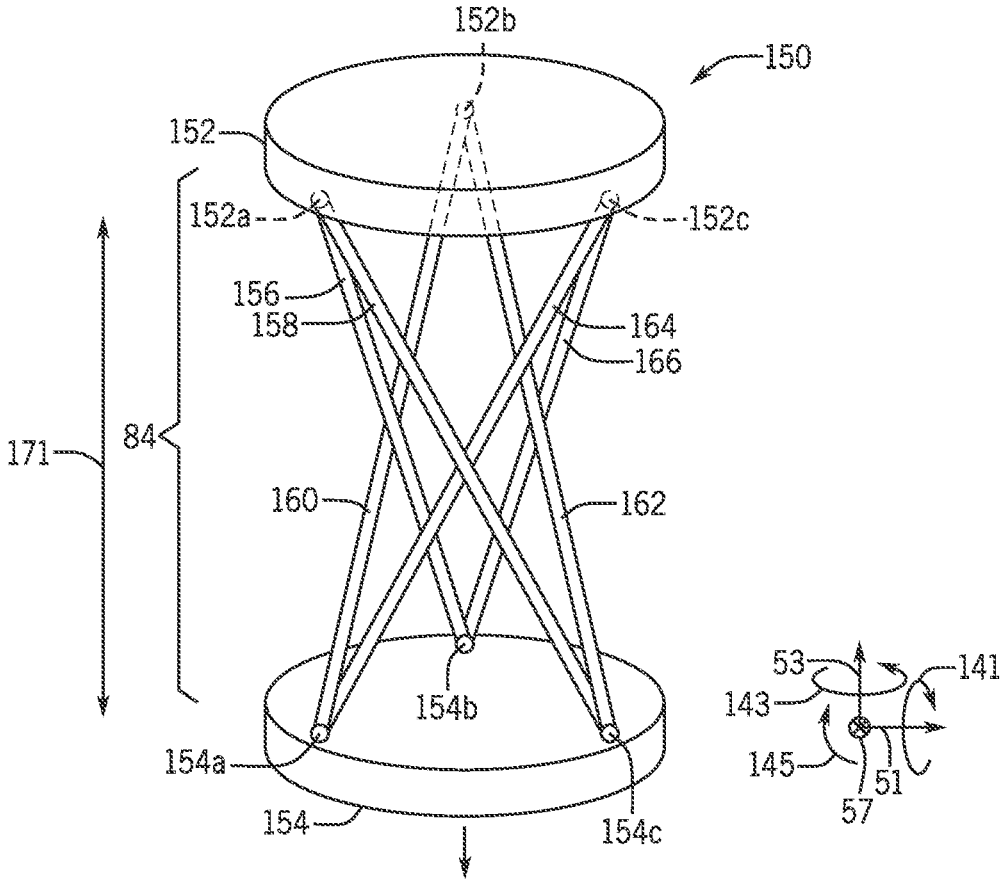
FIG. 8 is a schematic illustration of a perspective view of an embodiment of the inverted Stewart platform of FIG. 6, in accordance with an embodiment of the present disclosure.

FIG. 8 is a schematic illustration of an embodiment of the inverted Stewart platform 150. As shown in FIG. 8, the position of the lower platform 154 is further from the upper platform 152, along the direction 53, than is illustrated in FIG. 6. In other words, a distance 171 between the platforms 152, 154 is greater in FIG. 8 than in FIG. 6. This configuration may be produced, for example, via the extension of all of the legs 156, 158 160, 162, 164, 166 simultaneously. The distance 171 may be changed even when the inverted Stewart platform 150 is not in the aforementioned parallel position. Of course, in another operating sequence, the platforms 152, 154 may be drawn together via retraction of the legs 84. In either sequence, the new position may adjust the height of the ride vehicle (i.e., along the direction 53), which may enhance passenger experience. For example, the ride vehicle may be lowered to be in proximity of an element outside of the ride vehicle (e.g., such as an exhibit or attraction adjacent the ride vehicle). Further, as the ride vehicle is lowered, it may produce sensations to the passengers (i.e., a "falling" sensation) to enhance the ride experience.

As shown in FIGS. 7 and 8, the inverted Stewart platform 150 may induce several different motions upon the ride vehicle. As such, features of the track utilized to induce motions on the ride vehicle may be reduced, which may reduce a size and/or cost of the ride system. As previously described, the inverted Stewart platform 150 and the extension mechanism (e.g., extension mechanism 60 of FIGS. 2-5) may work in conjunction to emulate sensations similar or the same as those created by a track, while maintaining stability. For example, the track may no longer include an inclining hill, because the inverted Stewart platform 150 may enable tipping (and/or vertical lifting of the ride vehicle 54), in conjunction with vertical motion of the ride vehicle induced by the extension mechanism (e.g., extension mechanism 60 of FIGS. 2-5). This may reduce the costs of manufacturing the track and ride system as a whole, and may reduce a footprint of the track and the ride system as a whole.

In FIGS. 6-8, the upper platform 152 and the lower platform 154 are shown as circular slabs, but in another embodiment, they may be any suitable shape. Further, the upper platform 152 and the lower platform 154 may be of different shapes relative to one another. As noted above, in one embodiment, the upper platform 152 may couple with the extension mechanism (e.g., extension mechanism 60 in FIGS. 2-5) or the track (e.g., via an intervening bogie that slides along the track), and the lower platform 154 may couple with the ride vehicle. In this embodiment, the ride vehicle may dangle from the track, as shown in FIGS. 2 and 4 (i.e., illustrating the ride vehicle 54 and the track 52).

FIG. 9 illustrates another embodiment of a platform assembly 200. The platform assembly 200 may include an upper platform 202 and a lower platform 204. In this embodiment, the legs 202, 204, 206, 208, 210, 212 may be extended and/or retracted by actuators 230. As such, the legs may not be coupled to winches or include cables or ropes, although winches may be used in combination with the actuators 230.

To provide a more detailed view of one of the legs 84, FIG. 10 illustrates an embodiment of the actuator 230 that may be used in the platform assembly 200. Shown in the figure, the actuator 230 may include a middle segment 232 and two leg segments 234 coupled to both ends of each middle segment 232. The leg segments 234 may be metal, carbon fiber, another suitable material, or any combination thereof to allow for stable coupling with the actuator 230. The middle segment 232 may cause the leg segments 234 to telescope in and out of the middle segment 232 to operate the actuator 230 (e.g., to retract or extend, respectively, the corresponding leg).

Figure 11:
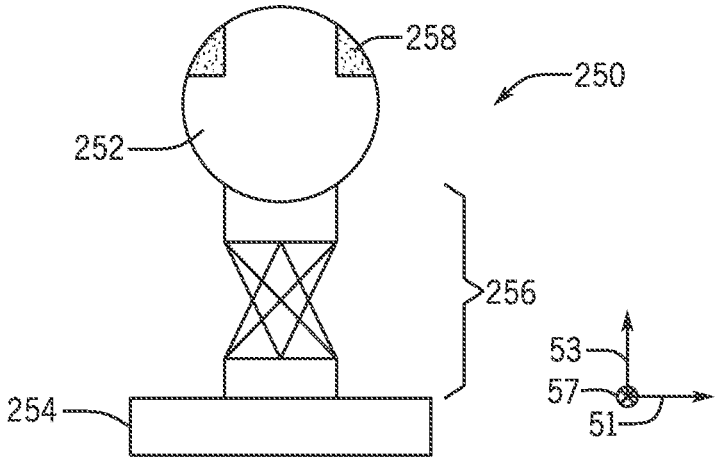
FIG. 11 is a schematic illustration of a side view of another embodiment of a ride system having a flying reaction deck with an inverted Stewart platform, in accordance with an embodiment of the present disclosure.

Additional embodiments of ride systems utilizing the platform assembly and/or extension mechanism(s) are described below. For example, FIG. 11 is a schematic illustration of an embodiment of a system 250 having a cabin 252 located atop a base 254 and atop an intervening platform assembly 256 (e.g., inverted Stewart platform), where the platform assembly 256 couples to the cabin 252 and the base 254. In this manner, the cabin 252 is oriented in a different manner in relation with the track 254 than is shown in FIG. 2. Windows 258 may be positioned or disposed on the cabin 252 to enable or block the view from within the cabin 252 of certain features, as previously described. The base 254 may be a track, or a fixed base associated with an exhibit or show. In some embodiments, the base 254 may be an open path through which the cabin 252 and corresponding inverted Stewart platform 256 may move (e.g., via wheels). It should be noted that the cabin 252 may be replaced by a show element in certain embodiments.

Figure 12:
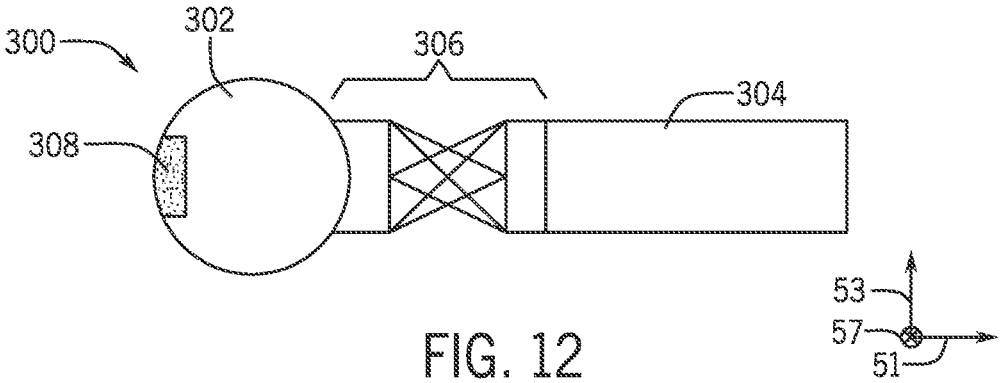
FIG. 12 is a schematic illustration of a side view of another embodiment of a ride system having a flying reaction deck with an inverted Stewart platform, in accordance with an embodiment of the present disclosure.

FIG. 12 is a schematic illustration of an embodiment of a system 300, where a cabin 302 of the system 300 is disposed at a side of a base 304 (e.g., in direction 51). Here, a platform assembly 306 (e.g., inverted Stewart platform) is located a distance in the direction 51 apart from the base 304, and the cabin 302 is further located a distance in the direction 51 coupled to the platform assembly 306. Similar to FIG. 11, windows 308 may be disposed on the cabin 302 to enable or block the view of certain features from within the cabin 302. As previously described, the base 304 may be a track, or a fixed structure. Further, while the cabin 302 is shown in the illustrated embodiment, the cabin 302 may be replaced by a show element in certain embodiments.

Figure 13:
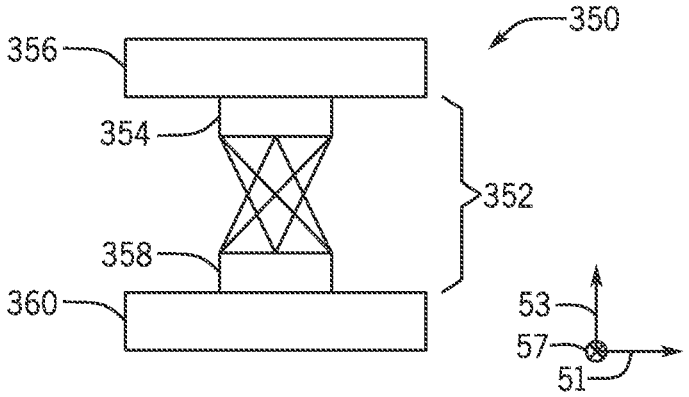
FIG. 13 is a schematic illustration of a side view of another embodiment of a ride system having a flying reaction deck with an inverted Stewart platform, in accordance with an embodiment of the present disclosure.

In another embodiment, as shown in FIG. 13, a system 350 may include a platform assembly 352 (e.g., inverted Stewart platform) implemented in a performance show. An upper platform 354 of the platform assembly 352 may be coupled to a stage 356, and a lower platform 358 may be coupled to a stationary element 360 (e.g., a ground or the floor beneath the stage 356). Thus, the stage 356 may be configured to hold one or more people (or show elements/components), and may be configured to move relative to the stationary element 360. For example, the one or more people may be performing an act and the platform assembly 352 may move the stage 356 to enhance the performance. In the systems presented in FIG. 11-13, a controller (e.g., the controller 20 of FIG. 1) may also monitor imparted forces on the respective ride systems (e.g., each of the legs) to ensure stability, similar to the description include above with reference to at least FIG. 5.

Figure 14:
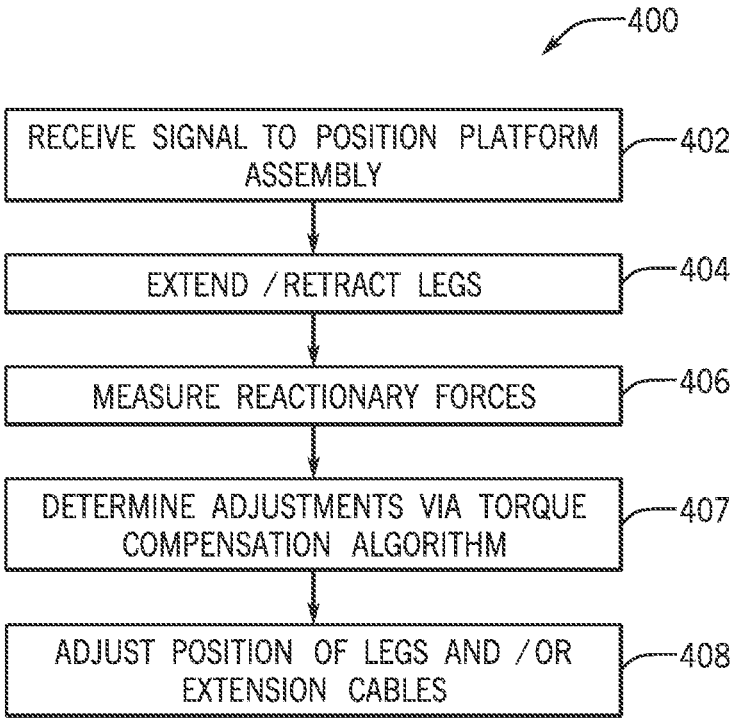
FIG. 14 is a block diagram illustrating an embodiment of a process for controlling a flying reaction deck having a platform assembly with an inverted Stewart platform, in accordance with an embodiment of the present disclosure.

FIG. 14 illustrates an embodiment of a method 400 for controlling a ride system, in accordance with the present disclosure. The method 400 includes receiving (block 402) a signal (e.g., at a controller) instructing a positioning of the platform assembly (or a platform thereof). For example, certain movement of the platform assembly may be desirable in order to cause a ride vehicle coupled to the platform assembly (e.g., to a lower platform of the platform assembly) to move (e.g., roll, pitch, yaw, up, or down). It should be noted that the platform assembly may be an inverted Stewart platform assembly, and that in some embodiments, the ride system may be a stage or other show exhibit in which a stationary base replaces the track.

The method 400 also includes extending and/or retracting (block 404), via instruction of motor winches or other actuators by the control, certain of the legs of the platform assembly to cause the platform assembly (or a platform thereof) to move in accordance with the instruction discussed above with respect to block 402. As previously described, movement of the platform assembly may cause a ride vehicle or cabin (or stage, in embodiments relating to shows or exhibits) of the system to move, which may cause reactionary forces on a load path (e.g., extension cables) between the ride vehicle and a track.

The method 400 also includes measuring, sensing, or detecting (block 406) reactionary forces (or parameters indicative of forces) in the ride system. For example, as previously described, torque sensors, optical sensors, or other sensors may be used to detect forces (or parameters, such as orientation of the ride vehicle, indicative of forces) in the ride system. The controller may receive the sensor feedback, and determine, based on a torque compensation algorithm, how best to manage the reactionary loads/forces of exerted by movement of the ride vehicle.

The method 400 also includes determining (block 407) adjustments to the system via a controller that analyzes the reactionary forces via a torque compensation algorithm. Further, the method 400 includes adjusting (block 408) the legs of the platform assembly and/or the extension cables. As previously described, the controller may determine the desired adjustments, and instruct motors or other actuators to adjust a tension in the legs and/or extension cables (e.g., by extending or retracting the legs and/or extension cables), which precludes the legs and/or extension cables from going slack.

The systems and methods described above are configured to enable management of reactionary loads on a ride system by movement of a ride vehicle, where the movement is caused by an extension mechanism and/or platform assembly (e.g., inverted Stewart platform). The extension mechanism and/or platform assembly causes the vehicle to move without utilizing curved track, where curved track would otherwise take a larger space and increase a footprint of the ride system. The feedback control enables the system to monitor reactionary forces caused by motion of the ride vehicle, and adjust the system to maintain stability of the ride system.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A method of operating a ride system, the method comprising:

determining, via a controller, first forces in the ride system during a first cycle of the ride system, wherein the ride system comprises a base, a ride vehicle, a platform assembly positioned between the base and the ride vehicle, and an extension mechanism positioned between the base and the ride vehicle, wherein the platform assembly comprises a first platform, a second platform, and a plurality of legs extending between the first platform and the second platform, and wherein the extension mechanism comprises a plurality of cables configured to extend and retract so as to move the ride vehicle relative to the base;

actuating, via the controller, the plurality of legs to move the first platform relative to the second platform to move the ride vehicle relative to the base;

causing, via the controller, a motor of a plurality of motors to output a first torque based on the first forces in the ride system to winch a cable of the plurality of cables to move the ride vehicle relative to the base;

determining, via the controller, second forces in the ride system during a second cycle of the ride system; and causing, via the controller, the motor of the plurality of motors to output a second torque based on the second forces in the ride system to winch the cable of the plurality of cables.

2. The method of claim 1, comprising:

actuating, via the controller, the plurality of legs to adjust the plurality of legs to a first position based on the first forces in the ride system during the first cycle; and actuating, via the controller, the plurality of legs to adjust the plurality of legs to a second position based on the second forces in the ride system during the second cycle.

3. The method of claim 2, comprising:

monitoring, via the controller, additional forces in the ride system caused by actuation of the plurality of legs of the platform assembly; and modulating, via the controller, torque output by the motor based on the additional forces in the ride system caused by the actuation of the plurality of legs.

4. The method of claim 1, comprising determining, via the controller, the first forces and the second forces in the ride system via data received from torque sensors configured to determine torque in the ride system, optical sensors configured to determine an orientation of the ride vehicle, or both.

5. The method of claim 1, wherein determining, via the controller, the first forces and the second forces in the ride system comprises determining a weight distribution of the ride vehicle.

6. The method of claim 1, wherein causing, via the controller, the motor of the plurality of motors to output the first torque, the second torque, or both causes an extension of the cable of the plurality of cables to move a portion of the ride vehicle away from the base.

7. The method of claim 1, wherein causing, via the controller, the motor of the plurality of motors to output the first torque, the second torque, or both causes a retraction of the cable of the plurality of cables to move a portion of the ride vehicle toward the base.

8. A non-transitory computer-readable medium comprising instructions, wherein the instructions, when executed by processing circuitry, are configured to cause the processing circuitry to:

determine first forces in a ride system during a first cycle of the ride system, wherein the ride system comprises a base, a ride vehicle, and a platform assembly positioned between the base and the ride vehicle, the platform assembly comprises a first platform, a second platform, and a plurality of legs extending between the first platform and the second platform;

adjust a leg of the plurality of legs to adjust the plurality of legs to a first position based on the first forces in the ride system;

determine second forces in the ride system during a second cycle of the ride system;

adjust the leg of the plurality of legs to adjust the plurality of legs to a second position based on the second forces in the ride system;

cause a plurality of motors configured to selectively winch a plurality of cables of an extension mechanism positioned between the base and the ride vehicle to output first torques based on the first forces in the ride system during the first cycle; and cause the plurality of motors to output second torques based on the second forces in the ride system during the second cycle.

9. The non-transitory computer-readable medium of claim 8, wherein the instructions, when executed by the processing circuitry, are configured to cause the processing circuitry to adjust the leg of the plurality of legs to cause movement of the ride vehicle relative to the base via movement of the first platform relative to the second platform.

10. The non-transitory computer-readable medium of claim 9, wherein the instructions, when executed by the processing circuitry, are configured to cause the processing circuitry to adjust the leg of the plurality of legs to roll, pitch, yaw, extend, retract, or any combination thereof the ride vehicle relative to the base.

11. The non-transitory computer-readable medium of claim 8, wherein the instructions, when executed by the processing circuitry, are configured to cause the processing circuitry to adjust the leg of the plurality of legs to cause an extension of or a retraction of the leg of the plurality of legs.

12. The non-transitory computer-readable medium of claim 8, wherein each leg of the plurality of legs comprises a respective actuator, and the instructions, when executed by the processing circuitry, are configured to actuate the respective actuator of the leg of the plurality of legs to adjust the leg.

13. The non-transitory computer-readable medium of claim 8, wherein the platform assembly comprises a plurality of winches configured to move the plurality of legs, and the instructions, when executed by the processing circuitry, are configured to actuate a winch of the plurality of winches to adjust the leg of the plurality of legs.

14. A method, comprising:

determining, via a controller, first forces in a ride system during a first cycle of the ride system, wherein the ride system comprises:

a base, a ride vehicle, a platform assembly positioned between the base and the ride vehicle and comprising a first platform, a second platform, and a plurality of legs extending between the first platform and the second platform, and an extension mechanism positioned between the base and the ride vehicle and coupled to the platform assembly, the extension mechanism comprising a plurality of cables configured to extend and retract to move the ride vehicle away from and toward, respectively, the base of the ride system;

causing, via the controller, a plurality of motors to output first torques to control tension in the plurality of cables of the extension mechanism, or actuating, via the controller, the plurality of legs of the platform assembly to adjust the plurality of legs to a first position and move the first platform relative to the second platform based on the first forces in the ride system;

determining, via the controller, second forces in the ride system during a second cycle of the ride system; and causing, via the controller, the plurality of motors to output second torques, or actuating, via the controller, the plurality of legs to adjust the plurality of legs to a second position based on the second forces in the ride system.

15. The method of claim 14, comprising:

determining, via the controller, reactionary forces in the ride system as a result of causing the plurality of motors to output torques, actuating the plurality of legs of the platform assembly, or both; and adjusting, via the controller, the torques output by the plurality of motors, the actuation of the plurality of legs, or both based on the reactionary forces.

16. The method of claim 14, wherein determining, via the controller, the first forces and the second forces in the ride system comprises monitoring forces imparted by the platform assembly onto the ride vehicle.

17. The method of claim 14, wherein actuating, via the controller, the plurality of legs of the platform assembly causes an extension of a first leg of the plurality of legs and a retraction of a second leg of the plurality of legs.

18. The method of claim 14, wherein causing, via the controller, the plurality of motors to output torques causes an extension of a first cable of the plurality of cables and a retraction of a second cable of the plurality of cables.

* * * * *